US012351348B1

(12) United States Patent
Akasaka

(10) Patent No.: US 12,351,348 B1
(45) Date of Patent: Jul. 8, 2025

(54) SUCTION TOOL

(71) Applicant: MORITA TRADING CO., LTD., Tokyo (JP)

(72) Inventor: Iwahiko Akasaka, Tokyo (JP)

(73) Assignee: MORITA TRADING CO., LTD., Tokyo (JP)

( * ) Notice: Subject to any disclaimer, the term of this patent is extended or adjusted under 35 U.S.C. 154(b) by 0 days.

(21) Appl. No.: 19/060,728

(22) Filed: Feb. 23, 2025

(30) Foreign Application Priority Data

Mar. 19, 2024 (JP) ..... 2024-043828

(51) Int. Cl.
*B65B 1/16* (2006.01)

(52) U.S. Cl.
CPC ..... *B65B 1/16* (2013.01)

(58) Field of Classification Search
CPC ..... B65B 1/16
See application file for complete search history.

(56) References Cited

U.S. PATENT DOCUMENTS 4,013,075 A * 3/1977 Cocozza ..... A61M 15/0028 222/85
4,117,844 A * 10/1978 James ..... A61M 15/0038 222/83.5
4,210,140 A * 7/1980 James ..... A61M 15/0028 604/59
5,651,359 A * 7/1997 Bougamont ..... A61M 15/0048 128/203.23
5,673,686 A * 10/1997 Villax ..... A61M 15/0038 128/203.19
5,921,237 A * 7/1999 Eisele ..... A61M 15/0025 128/203.15
2009/0071469 A1* 3/2009 Abrams ..... A61M 15/0028 128/200.14
2009/0194105 A1* 8/2009 Besseler ..... A61M 15/0028 128/203.15

FOREIGN PATENT DOCUMENTS

JP S52-098393 A 8/1977
JP S53-100695 A 9/1978
JP 62-202848 U 12/1987
JP H07-222800 A 8/1995
JP H08-224309 A 9/1996
JP 2000-504248 A 4/2000
JP 2009-533111 A 9/2009
JP 2010-538790 A 12/2010
WO WO-9727892 A1 * 8/1997 ..... A61M 15/00

* cited by examiner

*Primary Examiner* — Jeremy Carroll
(74) *Attorney, Agent, or Firm* — Frank Gao, Esq.

(57) ABSTRACT

The invention of the present application that solves the above problems includes: a cylindrical body; a rotating body connected to the cylindrical body so as to be relatively rotatable about a central axis; and a suction portion communicating with an outside. The cylindrical body includes a holding portion that holds a capsule, the rotating body includes a blade portion capable of breaking the capsule, the holding portion includes a capsule base that holds the capsule at a position away from the central axis, the blade portion is provided so as to relatively move along a movement path when the rotating body relatively rotates, and the capsule base is disposed on the movement path.

10 Claims, 7 Drawing Sheets

SUCTION TOOL

BACKGROUND

Technical Field

The present invention relates to a suction tool used for sucking an agent contained in a capsule.

Related Art

Conventionally, as a tool for sucking a liquid or powder agent, a suction tool for storing a capsule enclosing the agent is known. Such a suction tool can be used regardless of location and time by breaking the capsule by mechanical means at the time of use and sucking the liquid agent that has leaked and volatilized out of the capsule, or the powder that has been diffused. As such a suction tool, for example, a suction tool disclosed in JP 2010-538790 A is known.

SUMMARY

The invention described in JP 2010-538790 A is a specification in which a capsule disposed at the axial center is broken to take out an agent inside. Although the handling is easy, there are problems in that the degree of freedom in design is low, it is difficult to downsize since it is necessary to devise a gimmick of breaking, and the shape and capacity of the capsule are limited.

In view of the above problems, an object of the present invention is to provide a suction tool that is compact and in which handling performance can be enhanced.

The present invention that solves the above problems is a suction tool including: a cylindrical body; a rotating body coupled to the cylindrical body so as to be relatively rotatable about a central axis; and a suction portion communicating with an outside, in which the cylindrical body includes a holding portion that holds a capsule, the rotating body includes a blade portion capable of breaking the capsule, the holding portion includes a capsule base that holds the capsule at a position away from the central axis, the blade portion is provided so as to relatively move along a movement path when the rotating body relatively rotates, and the capsule base is disposed on the movement path.

With such a configuration, it is possible to provide a suction tool that can easily break the capsule inside by a rotation operation while making the entire configuration compact with a simple structure.

In a preferred mode of the present invention, a carrier capable of holding liquid is disposed between the capsule base and the suction portion. With such a configuration, persistence of suction is improved. In addition, since the blade portion protrudes in parallel with the central axis, a plurality of the blade portions is provided at intervals, and a plurality of the holding portions is provided on the movement path, the structure of the blade portion can be simplified and strengthened, and the capsule can be reliably broken. In addition, since a plurality of the holding portions is provided in the axial direction and each of the blade portions faces a respective one of the holding portions, handling performance is further enhanced.

The present invention is a method of using the suction tool described above, including a rotation step of relatively rotating the rotating body with respect to the cylindrical body. With such a configuration, the capsule inside can be easily broken only by rotating.

The present invention that solves the above problems can provide a suction tool that is compact and in which handling performance can be enhanced.

BRIEF DESCRIPTION OF DRAWINGS

FIG. 1(*b*) is a perspective view of a suction tool according to a first embodiment of the present invention;

FIG. 4(*b*) is an explanatory view of a cylindrical body according to the first embodiment of the present invention;

FIG. 4(*c*) is an explanatory view of a cylindrical body according to the first embodiment of the present invention;

FIG. 5(*b*) is an explanatory view of a rotating body according to the first embodiment of the present invention;

DETAILED DESCRIPTION

Hereinafter, a suction tool according to each embodiment of the present invention will be described with reference to the drawings. The description will be given in detail in the order of the configuration of the embodiment, the implementation method, and other examples. Note that the following embodiments are examples of the present invention, and the present invention is not limited to the following embodiments. In addition, "substantially" in the application document is a concept that means that chamfering or rounding is performed on a shape subsequent to "substantially", and that an element constituting the shape is deformed or changed in length within a range not hindering the purpose of the configuration.

First Embodiment

Figure 1A:
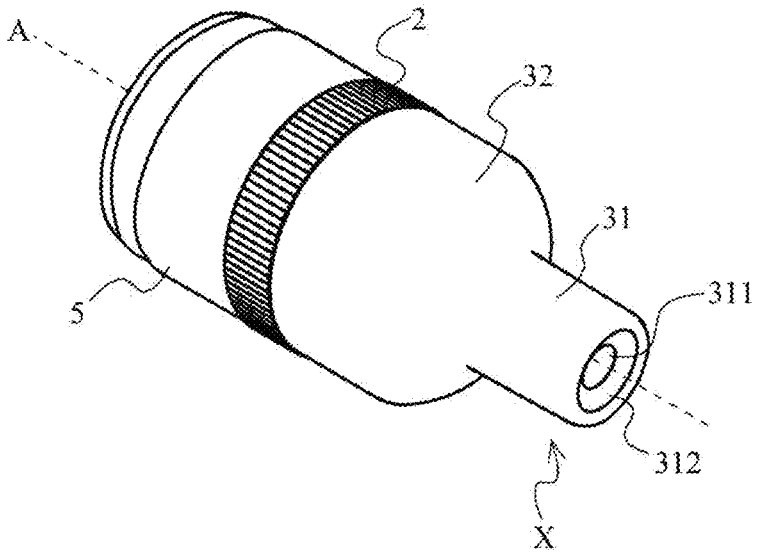
FIG. 1(*a*) is a perspective view of a suction tool according to a first embodiment of the present invention.
Figure 1B:
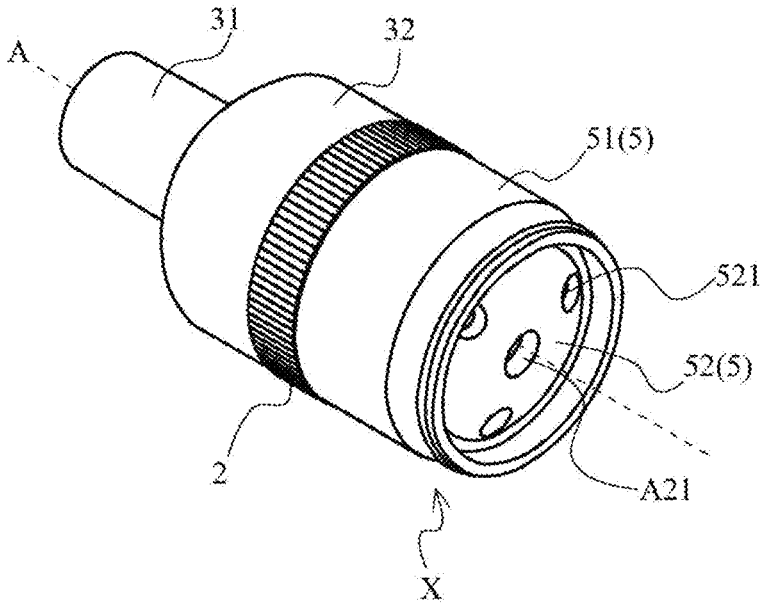

As illustrated in FIGS. 1(*a*) to 3, a suction tool X includes a cylindrical body 1, a rotating body 2 connected to the cylindrical body 1 so as to be relatively rotatable about a central axis A, and a suction portion 3 that communicates an inside with an outside. The cylindrical body 1 includes a holding portion 13 that holds a capsule C, the rotating body 2 includes a blade portion 22 capable of breaking the capsule C, the holding portion 13 includes a capsule base 132 that holds the capsule C at a position away from the central axis A, a blade portion 22 is provided so as to relatively move along a movement path R when the rotating body 2 relatively rotates, and the capsule base 132 is disposed on the movement path R.

In addition, the suction tool X includes a carrier 4 capable of holding the liquid inside the capsule C, a bottom base 5 that holds a lower end and defines an internal space, a sub-cylindrical body 6 that is provided between the cylindrical body 1 and the bottom base 5 and holds the capsule C similarly to the cylindrical body 1, and a sub-carrier 7 capable of holding the liquid similarly to the carrier 4 corresponding to the sub-cylindrical body 6. Furthermore, all of the above parts are made of the same plastic member, so that manufacturing cost is reduced and time and effort for sorting are reduced.

In the embodiment, the capsule C is a member that stores a liquid agent in a state of being sealed therein, and is a material having various shapes such as a cylindrical shape, a spherical shape, and an elliptical spherical shape in which both sides are hemispherical. A shell of the capsule C has rigidity of a degree to be cracked or crushed by the force of the blade portion 22, and the liquid agent is volatile.

In addition, the central axis A in the embodiment is a central axis of the suction tool X having a cylindrical shape as a whole, and the constituent material of the suction tool X rotates about this axis. Further, the constituent material of the suction tool X includes a rigid shaft portion A1 extending along the central axis A and a shaft hole A2 penetrating the shaft portion A1.

Figure 2:
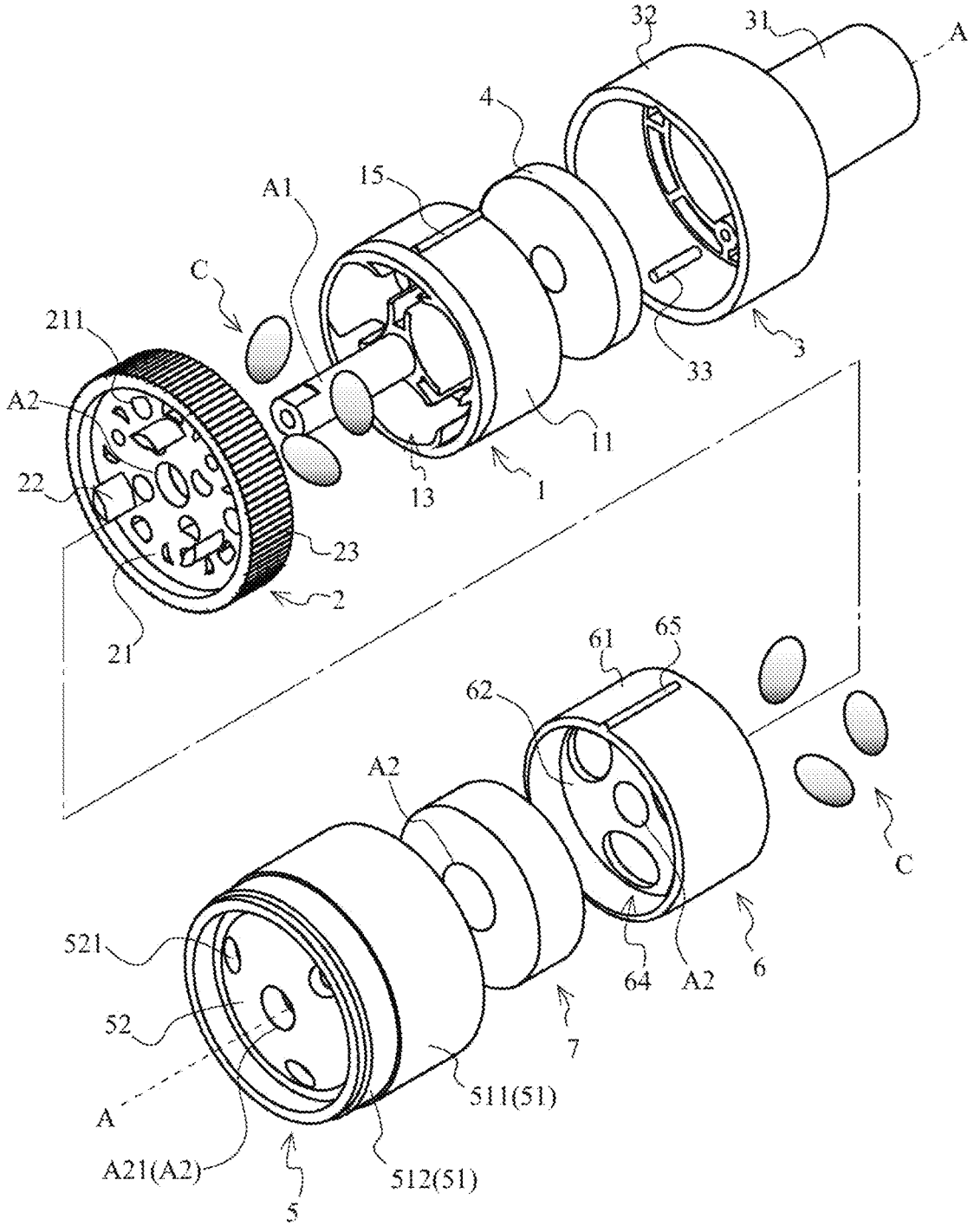
FIG. 2 is an exploded perspective view of the suction tool according to the first embodiment of the present invention.
Figure 3:
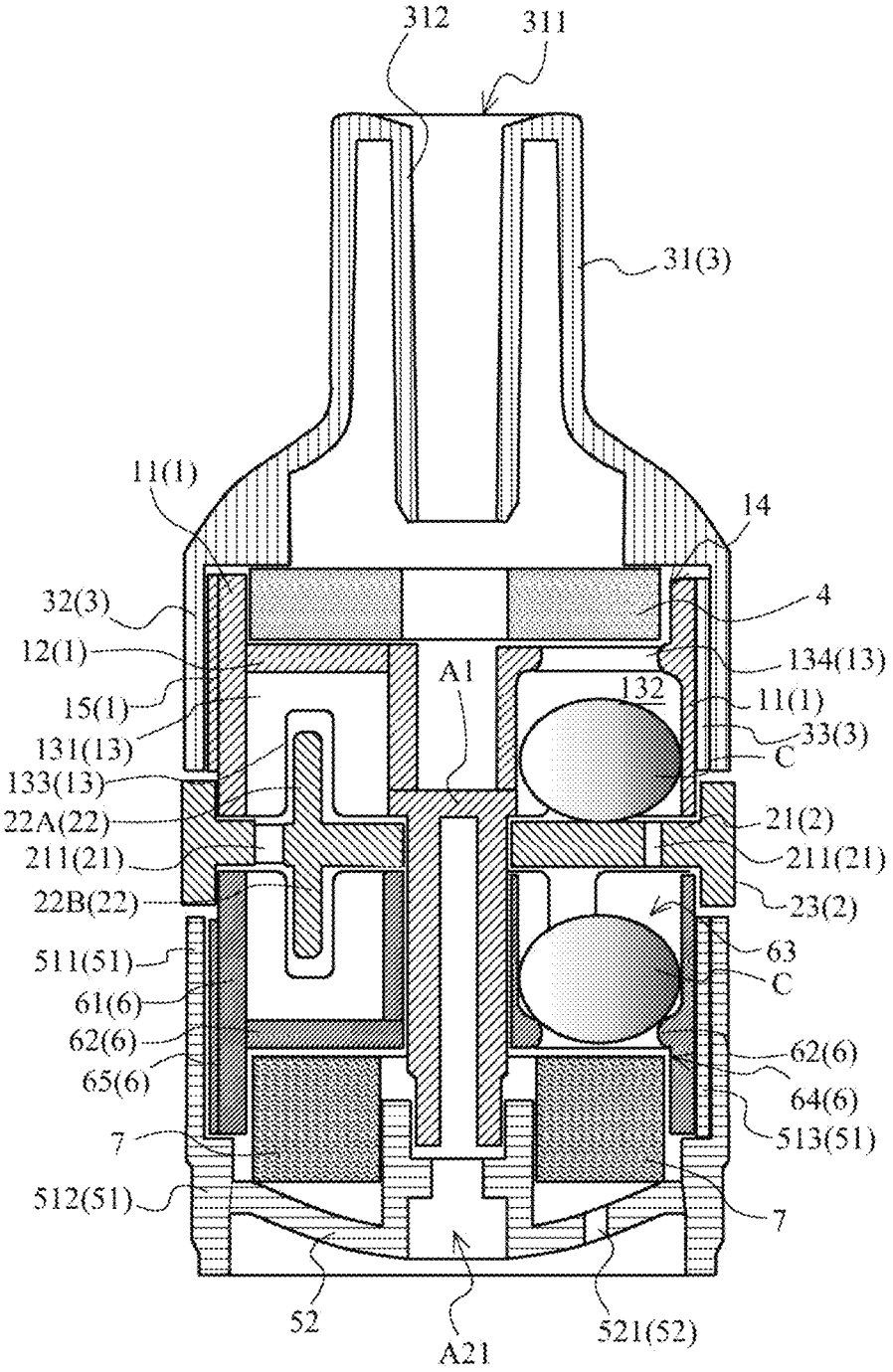
FIG. 3 is a schematic cross-sectional view of the suction tool according to the first embodiment of the present invention.
Figure 4A:
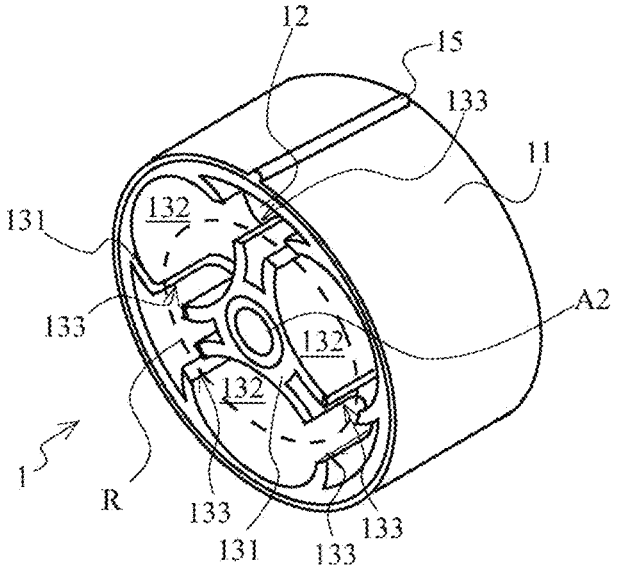
FIG. 4(*a*) is an explanatory view of a cylindrical body according to the first embodiment of the present invention.
Figure 4B:
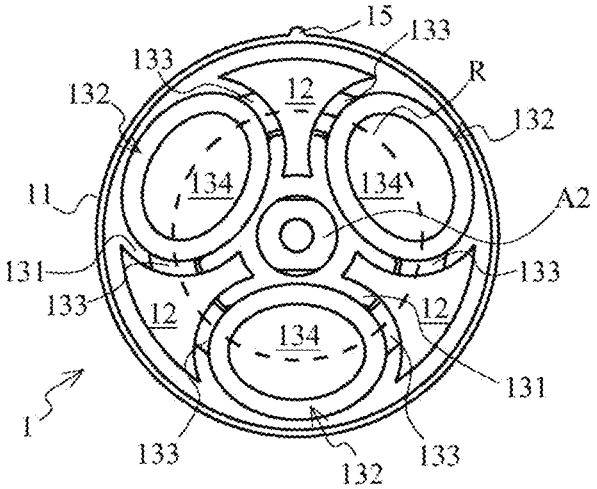
Figure 4C:
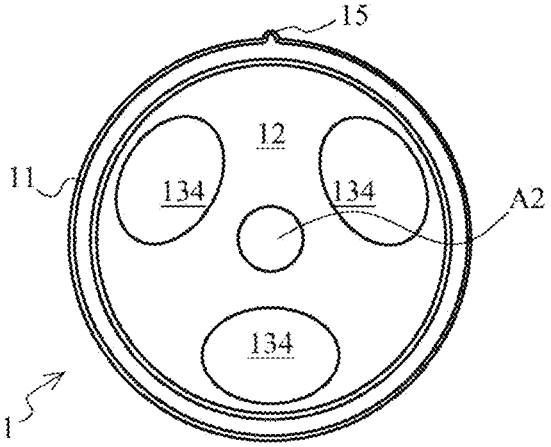

As illustrated in FIGS. 2 to 4(*c*), the cylindrical body 1 is a cylindrical member that holds the capsule C, and includes a cylindrical main body 11 and a partition wall 12 that is plane-stretched in a direction perpendicular to an axial direction and divides a space inside the cylindrical main body 11 into two. On each surface of the partition wall 12, the holding portion 13 that holds the capsule C and a carrier storage portion 14 for holding and storing the carrier 4 are provided on front and back surfaces of the partition wall 12. In addition, the cylindrical body 1 includes a holding portion fitting portion 15 for rotating the suction portion 3 and the cylindrical body 1 in cooperation, and is provided with the shaft portion A1 extending in the direction to the bottom base 5.

Note that FIG. 4(*a*) is a perspective view of the cylindrical body 1 in which the shaft portion A1 is omitted, FIG. 4(*b*) illustrates a surface of the cylindrical body 1 viewed from the bottom base 5 side, and FIG. 4(*c*) illustrates a surface of the cylindrical body 1 viewed from the suction portion 3 side.

In the embodiment, the cylindrical main body 11 is a material that is fitted to an inner peripheral surfaces of the rotating body 2 and the suction portion 3 and substantially the cylindrical main body 11 is covered entirely. This makes the overall structure compact and improves durability. In addition, a portion of the cylindrical body 1 that is fitted to the rotating body 2 is provided with a step that is smooth and makes the diameter small to define an attachment position. An outer peripheral surface of the suction tool X is a uniform surface as a whole.

The holding portion 13 is a portion provided inside the cylindrical main body 11 and faces the rotating body 2. The holding portion 13 includes a partition 131 that protrudes in parallel with the axial direction, the capsule base 132 that is defined by the partition 131 and is a surface for holding the single capsule C, a path hole 133 provided so that the blade portion 22 and the partition 131 do not interfere with each other, and an opening 134 inserted through the partition wall 12 in order to send the liquid agent leaking from the capsule C to the carrier 4.

The partition 131 is a material that partitions the internal space of the holding portion 13 surrounded by the partition wall 12 and the inner peripheral surface of the cylindrical body 1, and is formed integrally with the cylindrical body 1. More specifically, the partition 131 includes a portion provided so as to surround the peripheral surface of the shaft portion A1 and a portion protruding from the inner peripheral surface of the cylindrical body 1, and is provided in a curved shape such that the respective portions face each other in plan view. In addition, the height of the partition 131 is provided to be at least higher than the height of the short axis of the capsule C, and is preferably substantially the same as the height to the end surface of the cylindrical body 1 to enhance the strength.

The capsule base 132 is a portion defined by the partition wall 12 and the peripheral surface of the partition 131, and forms a space for storing one capsule C. In the embodiment, three capsule bases 132 are provided point-symmetrically and at equal intervals, but four or more capsule bases 132 may be provided according to the diameter of the cylindrical body 1. In addition, the capsule base 132 preferably has a shape and a size that are substantially the same as or slightly larger than a part of the cross section of the capsule C in plan view. By holding the capsule C at a fixed position, the capsule C is easily broken when the blade portion 22 acts, and is prevented from being unintentionally broken due to impact.

Furthermore, a space wider than the width of the blade portion 22 is provided between the adjacent capsule bases 132, and the blade portion 22 is positioned in this space in an initial state (state of not rotating, state of FIGS. 3 and 7) so as not to abut on the capsule C.

The path hole 133 is a hole provided on the surface of the partition 131 so as to be positioned on the movement path R indicated by a broken line in FIGS. 4(*a*) and 4(*b*). The path hole 133 is cut out from an upper end of the partition 131, and has a width at least wider than the width of the blade portion 22 and narrower than the outer diameter of the capsule C so that the capsule C does not escape from the capsule base 132 and does not interfere with the blade portion 22. Further, the height of the path hole 133 is longer than the protruding height of the blade portion 22 from the rotating body 2 so that the capsule C does not interfere with the blade portion 22.

The opening 134 is a hole provided in the partition wall 12 so that the capsule base 132 and the carrier storage portion 14 pass through. The liquid agent that has passed therethrough is held by the carrier 4. In addition, the opening 134 has substantially the same shape as a part of the cross section of the capsule C, and the maximum diameter of the opening 134 is provided to be at least smaller than the maximum diameter of the capsule C, so that the part of the capsule C always abuts on the peripheral edge of the opening 134 to enhance the holding performance of the capsule base 132 to the inside.

The carrier storage portion 14 is provided on the back surface side of the holding portion 13 viewed from the partition wall 12 and faces the suction portion 3. The carrier storage portion 14 is a portion defined by the inner peripheral surface of the cylindrical body 1 and the partition wall 12, and holds the carrier 4 by sandwiching the carrier 4 therein. The height of the carrier storage portion 14 is preferably smaller than the height of the holding portion 13 to make the carrier storage portion compact.

The holding portion fitting portion 15 is provided on the outer peripheral surface of the cylindrical body 1, and is fitted to a suction fitting portion 33 provided in the suction portion 3 in a relationship of a key and a key groove, thereby the cylindrical body 1 and the suction portion 3 rotate in cooperation with each other.

The shaft portion A1 is a rod-shaped member extending from the partition wall 12 toward the bottom base 5, passes through the shaft hole A2 provided in the rotating body 2, the sub-cylindrical body 6, and the sub-carrier 7 to be described later, and is fitted to a bottom shaft hole A21 provided in the bottom base 5. As a result, the penetrated member is easily rotated about the central axis A. Further, an end portion of the shaft portion A1 is provided having a non-circular shape (for example, a shape in which a notch or a chamfer is provided in a part of the peripheral surface), and is fitted to the bottom shaft hole A21 provided having a similar shape so that the cylindrical body 1 and the bottom base 5 rotate in cooperation.

As illustrated in FIGS. 2 and 3, the rotating body 2 is a member that is provided between the cylindrical body 1 and the sub-cylindrical body 6 and is provided to be relatively rotatable with respect to these materials, and includes a disk-shaped rotating board 21, the blade portion 22 extending from the rotating board 21, and a rotating cylinder 23 that covers an outer peripheral surface of the rotating board 21.

Figure 5A:
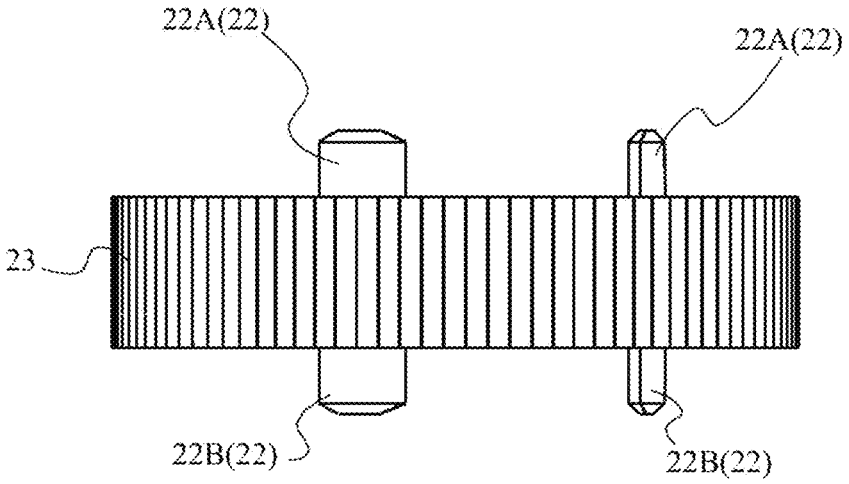
FIG. 5(*a*) is an explanatory view of a rotating body according to the first embodiment of the present invention.
Figure 5B:
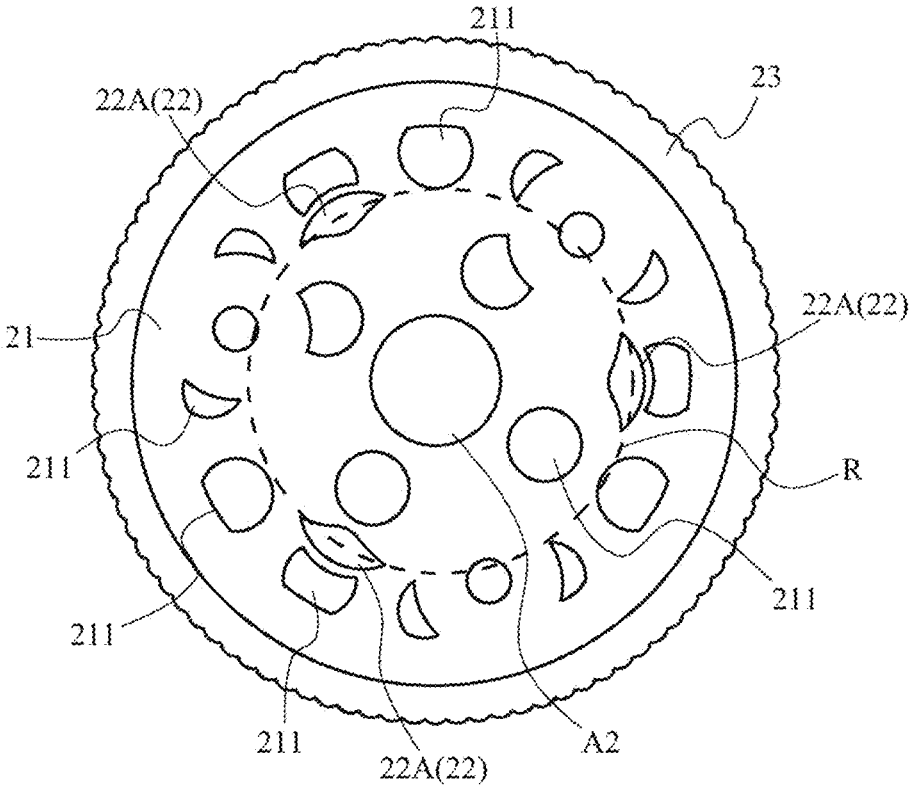

As illustrated in FIGS. 5(*a*) and 5(*b*), the rotating board 21 includes a plurality of vent holes 211 through which the volatilized agent supplied from the sub-cylindrical body 6 or the sub-carrier 7 passes when sucked from the suction portion 3, and the shaft hole A2 through which the shaft portion A1 passes. Note that FIG. 5(*a*) is a side view of the rotating body 2, and FIG. 5(*b*) is a plan view thereof.

The vent holes 211 are a plurality of holes provided so as to penetrate through the thickness direction of the rotating board 21, and the area of the vent holes 211 in the entire rotating board 21 is about 10% to 50%, so that both durability and air permeability can be achieved.

In addition, the shaft hole A2 of the rotating board 21 is a circular hole, and its diameter is slightly larger than the diameter of the shaft portion A1 so as to be loosely fitted. As a result, the rotating body 2 can be relatively rotated with respect to the cylindrical body 1 and the like with the shaft portion A1 as an axis.

The blade portion 22 is a member that protrudes parallel to the axial direction at a position away from the central axis A of the rotating board 21, and has a length that is at least a length that penetrates the capsule base 132 and is shorter than the cylindrical body 1. In the embodiment, a plurality of the blade portions 22 is provided at equal distances from the central axis A, and the number of the blade portions is equal to the number of the capsule bases 132. Furthermore, the interval is equal to the interval of the capsule bases 132. As a result, a plurality of capsules can be broken at a time, and the amount of the agent that can be sucked can be increased. Further, in the embodiment, the blade portion 22 is provided integrally with the rotating board 21, but a metal or ceramic blade portion 22 may be attached.

In addition, the blade portion 22 of the embodiment includes a plurality of first blades 22A extending toward the holding portion 13 of the cylindrical body 1 and a plurality of second blades 22B extending toward a sub-holding portion 63 of the sub-cylindrical body 6, on the front surface and the back surface of the rotating board 21. As a result, the capsules C stored in the cylindrical body 1 and the sub-cylindrical body 6 can be broken, and the amount of the agent that can be sucked is further increased.

When the rotating body 2 rotates relative to the cylindrical body 1, the blade portion 22 rotates relative to the capsule base 132 about the central axis A. At this time, a path along which the blade portion 22 moves inside the holding portion 13 is the movement path R, and in the embodiment, the path has a circular shape centered on the shaft portion A1.

Here, as illustrated in FIG. 3, the initial position of the blade portion 22 is preferably between the capsule bases 132, thereby preventing the capsules from being broken unexpectedly. In addition, the blades constituting the first blades 22A all have the same movement path R, and the blades constituting the second blades 22B all have the same movement path R, which simplifies the structure.

The blade portion 22 is provided such that a portion facing the shaft portion A1 is a wide thin plate member. More specifically, the thin plate member of the blade portion 22 is provided such that the width further narrows from the central axis to the side end portion, and the narrow side surface end portion is provided along the movement path R, so that the pressure of the portion abutting on the capsule C is increased to easily break the capsule C. In addition, since the above-described structure is provided at both ends on the movement path R of the blade portion 22, the capsule C can be broken even if the rotating body 2 is rotated in either direction.

The rotating cylinder 23 has the rotating board 21 disposed in an intermediate portion, and is provided so as to protrude to cover the outer peripheral edge of the rotating board 21. By loosely fitting a part of the outer peripheral surface of the cylindrical body 1, the inner peripheral surface of the rotating cylinder 23 facilitates positioning and rotation about the central axis A, and prevents the liquid agent of the capsule C from leaking to the outside of the suction tool X. In addition, the outer peripheral surface of the rotating cylinder 23 is provided with recessed and projection parts parallel to the axial direction, so that the user can easily turn the rotating cylinder 23 while holding the recessed and projection parts.

The suction portion 3 is a portion for the user to perform a suction operation by bringing the nose or the mouth in contact therewith, and is provided in a tapered shape as a whole. In the embodiment, the suction portion 3 includes a suction portion main body 31 that is provided at one end of the suction tool X and comes into contact with the user during use, a cylinder covering portion 32 that covers the outer peripheral surface of the cylindrical body 1, and a suction fitting portion 33 that fits into the holding portion fitting portion 15.

The suction portion main body 31 includes a tapered portion that is adjacent to the cylinder covering portion 32 and tapered toward the end portion, and a cylindrical portion having a smaller diameter than the cylinder covering portion 32. The small-diameter cylindrical portion is folded inward at a suction port 311 at an end portion thereof to form a return part 312.

The return part 312 is spaced from the outer periphery of the cylindrical portion and extends substantially parallel to the shaft portion to the tapered portion. The inner diameter of the return part 312 is smaller than the diameter of the shaft portion A1, and prevents the liquid not held by the carrier 4 from being sucked as it is.

The cylinder covering portion 32 is provided so as to fit the outer peripheral surface of the cylindrical body 1 with its inner peripheral surface. In addition, the suction fitting portion 33 that fits into the holding portion fitting portion 15 is integrally provided on the inner peripheral surface of the cylinder covering portion 32, and this forms a relationship of a key and a key groove, thereby the cylindrical body 1 and the suction portion 3 rotate in cooperation with each other.

The carrier 4 is a member stored between the cylindrical body 1 and the suction portion 3, and examples thereof include porous materials such as sponge, cotton, and non-woven fabric. The carrier 4 is a flexible columnar member whose outer diameter is substantially the same as or slightly larger than the inner diameter of the carrier storage portion 14, and is held in a state of being stored between the carrier storage portion 14 and the suction portion 3. The carrier 4 has a volume larger than at least the total volume of the liquid inside the capsule C held by the holding portion 13, and is carried until the liquid of the capsule C is volatilized. In addition, a hole is provided in the central axis A or the like to increase the surface area and increase the volatility of the liquid agent.

The bottom base 5 is disposed at the end portion in the axial direction, and includes a cylindrical bottom cylinder 51 into which gas is sucked, and a bottom surface portion 52 disposed so as to be plane-stretched to the bottom cylinder 51.

The bottom cylinder 51 includes an insertion portion 511 into which the sub-cylindrical body 6 is inserted, an extension portion 512 provided integrally with the insertion portion 511 and protruding so as to extend in an end direction, and a bottom base fitting portion 513 provided in the insertion portion 511. An inner peripheral surface of the insertion portion 511 is fitted to the outer peripheral surface of the sub-cylindrical body 6, and the bottom base 5 and the sub-cylindrical body 6 rotate in cooperation with each other as the bottom base fitting portion 513 is in a relationship of a key and a key groove with the sub-holding portion fitting portion 65 to be described later. Since the end surface of the extension portion 512 is substantially perpendicular to the central axis A and is provided outside the end portion of the bottom surface portion 52, the suction tool X can be erected so that the suction portion 3 does not contact the ground.

The bottom surface portion 52 includes a bottom shaft hole A21 provided on the central axis A so as to be fitted to shaft portion A1, and a suction hole 521 provided in the periphery of the bottom shaft hole A21 and being a hole for sucking air.

In addition, the bottom surface portion 52 is provided so as to bulge toward the end portion side about the central axis A, thereby securing a space for the bottom shaft hole A21 and enhancing strength.

The bottom shaft hole A21 is a part of the shaft hole A2, and is provided such that a cylindrical material extends from the bottom surface portion 52 in the direction of the suction portion 3, and an inner peripheral surface of the extending portion is fitted to the outer periphery of the shaft portion A1. Note that a screw hole may be provided on the inner periphery of the bottom shaft hole A21, and also the shaft portion A1 may be provided in a hollow shape so that a screw can be attached. In this case, by attaching the screw, the bottom base 5 and the cylindrical body 1 are fixedly connected, and the rotating body 2 and the like therebetween can also be stably held.

The suction hole 521 is a communication hole portion, and is provided so as to face the sub-carrier 7 away from the bottom shaft hole A21, thereby enabling suction of air. Here, the suction hole 521 faces the sub-carrier 7 so as to form a gap with the sub-carrier 7, and the suction is facilitated by increasing the surface area of the sub-carrier 7 that is not in contact with other components.

The sub-cylindrical body 6 has substantially the same structure as the cylindrical body 1, and includes a cylindrical sub-cylindrical main body 61, a sub-partition wall 62 that is provided to be plane-stretched on the inner side of the sub-cylindrical body 6 and divides the space inside the sub-cylindrical main body 61 into two, the sub-holding portion 63 that holds the capsule inside, a sub-carrier storage portion 64 that stores the sub-carrier 7, the sub-holding portion fitting portion 65 that fits into the bottom base 5, and the shaft hole A2.

The sub-holding portion 63 has substantially the same function and structure as the holding portion 13, and includes a partition, a capsule base, a path hole, and an opening. Here, the partition of the sub-holding portion 63 includes a portion surrounding the shaft hole A2 has a cylindrical shape in which the shaft portion A1 is loosely fitted.

Further, the sub-carrier storage portion 64 has substantially the same structure as the carrier storage portion 14, but the capacity of the sub-carrier storage portion 64 is larger than the capacity of the carrier storage portion 14.

The sub-holding portion fitting portion 65 is provided on the outer peripheral surface of the sub-cylindrical main body 61, and the sub-cylindrical body 6 and the bottom base 5 rotate in cooperation with each other as the sub-holding portion fitting portion 65 is in a relationship of a key and a key groove with the bottom base fitting portion 513. A plurality of fitting portions having a relationship of a key and a key groove, including the sub-holding portion fitting portion 65, may be provided, and the shape may be a semi-cylinder fitted as illustrated in the drawing, or may be simply a projection.

Similarly to the carrier 4, the sub-carrier 7 is a cylindrical material having water absorbency, and is provided so as to be sandwiched between the sub-carrier storage portion 64 and the bottom cylinder 51. The sub-carrier 7 has substantially the same structure, function, and shape as those of the carrier 4, but has a capacity larger than that of the carrier 4 so as to reliably hold the liquid agent directed toward the bottom base 5 in accordance with gravity and not to leak out, and may have a thickness larger than the height of the sub-carrier storage portion 64. Further, the sub-carrier 7 includes the shaft hole A2 penetrating the center.

The sub-carrier 7 also includes the shaft hole A2, which is a circular hole for penetrating the shaft portion A1 on the central axis A. The shaft hole A2 is provided such that the outer diameter and the inner diameter of the bottom shaft hole A21 are substantially the same as or slightly larger than each other, and rotates in cooperation with the bottom base 5. Since the inner diameter of the shaft hole A2 is provided so as to be smaller than the distance from the central axis A to the opening of the sub-partition wall 62, it is possible for the liquid agent of the capsule C to leak onto the sub-carrier 7 and be reliably held.

Hereinafter, a method for implementing the present invention will be described in detail with reference to FIGS. 1(*a*) to 5(*b*). The present invention is implemented by a user who volatilizes and sucks a liquid agent inside the capsule C. In addition, the following implementation method is an example, and the implementation method is not limited thereto and the order may be sequential.

First, as a rotation step, the user rotates the rotating body 2 while holding the suction portion 3 or the bottom base 5. As a result, the rotating body 2 rotates relative to the cylindrical body 1 provided inside the suction portion 3 and to the sub-cylindrical body 6 provided inside the bottom base 5, and the blade portion 22 moves on the movement path R. At this time, the blade portion 22 moves to the capsule base 132 through the path hole 133, and further breaks the capsule C held here by crushing or cutting. The user can easily break the capsule inside only by a rotation operation. In addition, at this time, the plurality of blade portions 22 can break the capsules C substantially at the same time, so that the amount of liquid agent that can be sucked at a time is increased.

Next, as a standby step, the user waits until the liquid leaking from the capsule C is held by the carrier 4 or the sub-carrier 7 through the cylindrical body 1, the opening of the sub-cylindrical body 6, or the vent hole 211, and volatilized.

Finally, as a suction step, the user brings the suction portion 3 to the mouth or nose to suck. The agent volatilized from the sub-carrier 7 passes through the sub-holding portion 63 and reaches the carrier storage portion 14 through the vent hole 211 and the opening 134. Here, the agent is merged with the agent volatilized from the carrier 4, and is sucked from the opening of the suction portion 3 as it is. At this time, by sucking the air from the suction hole 521, it is possible to prevent the inside of the suction tool X from being depressurized making it difficult to suck the air. In addition, since the shaft portion A1 has a cylindrical shape but does not penetrate, the concentration of the volatilized agent can be increased.

Second Embodiment

Figure 6:
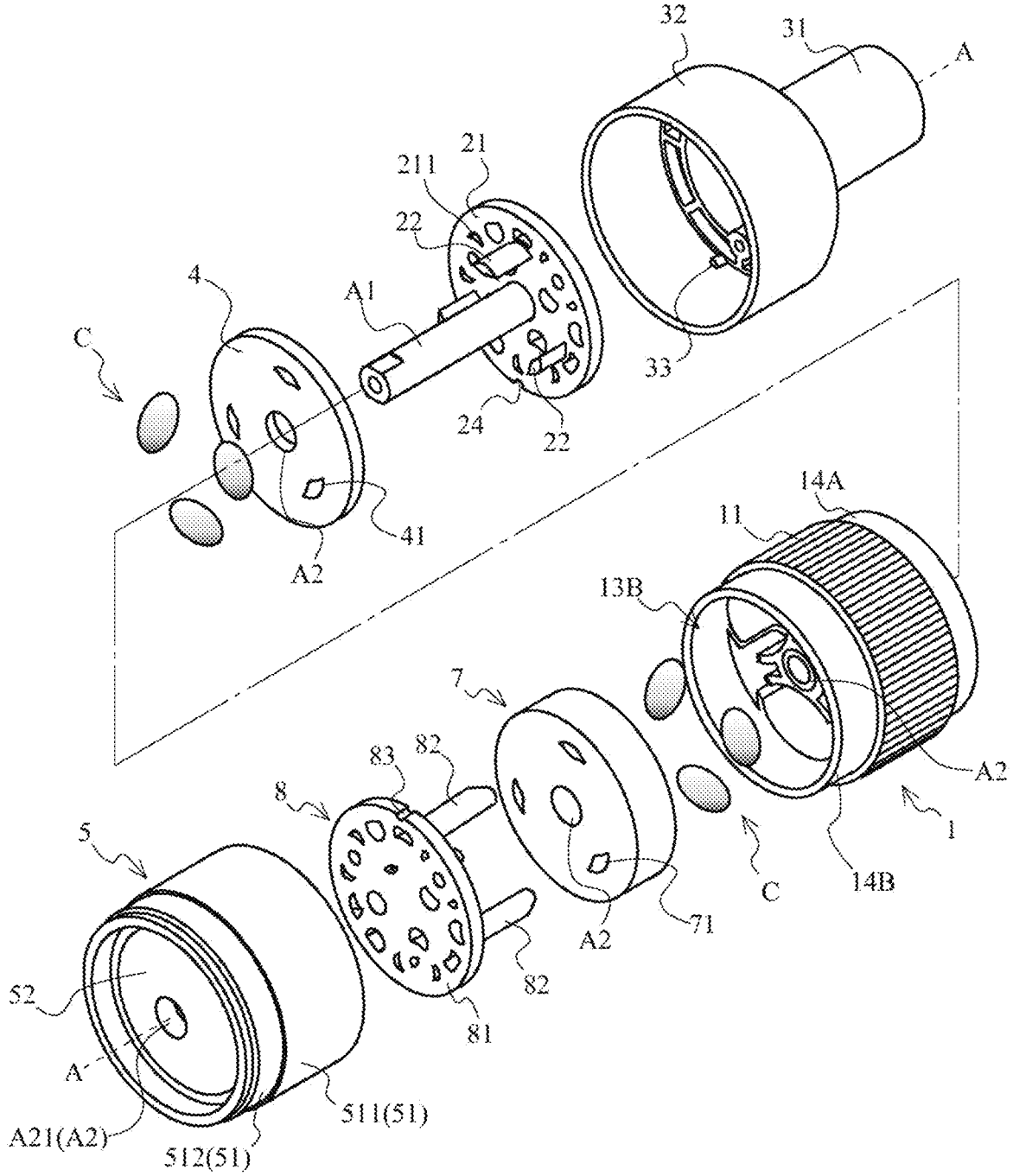
FIG. 6 is an exploded perspective view of a suction tool according to a second embodiment of the present invention.
Figure 7:
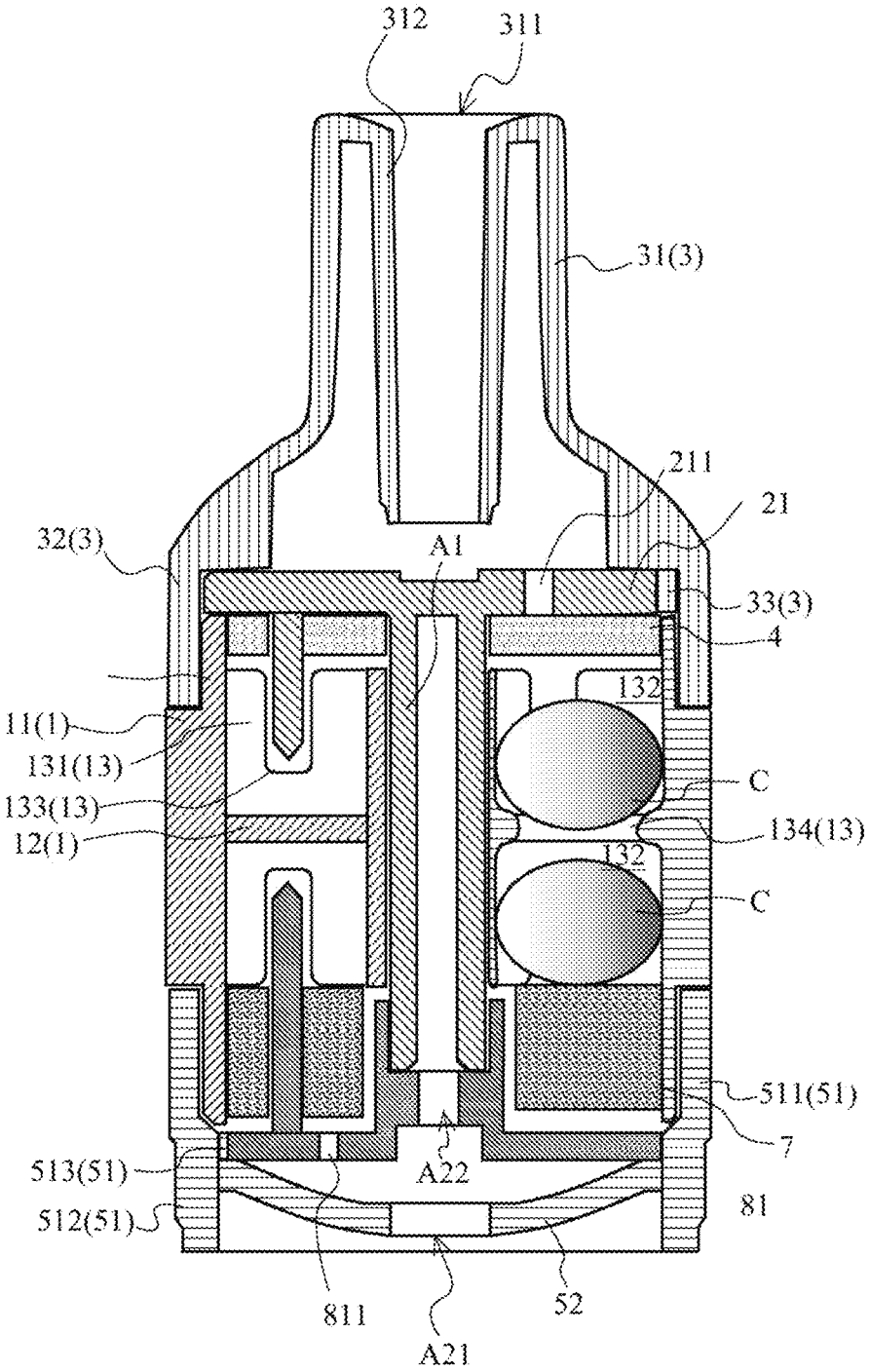
FIG. 7 is a schematic cross-sectional view of the suction tool according to the second embodiment of the present invention.

Hereinafter, a suction tool X according to a second embodiment of the present invention will be described with reference to FIGS. 6 and 7. Here, components having functions similar to those of the first embodiment are denoted by the same reference numerals, and description thereof is omitted.

The suction tool X includes a cylindrical body 1 that holds a capsule C therein, a rotating body 2 that is rotatable relative to the cylindrical body 1 about a central axis A, a suction portion 3 that is sucked by a user, a carrier 4 that holds the liquid, and a bottom base 5 that holds a lower end. In the embodiment, the cylindrical body 1 is provided so as to be sandwiched between the rotating body 2 and a sub-rotating body 8, and a sub-carrier 7 is provided between the cylindrical body 1 and the sub-rotating body 8. In addition, the cylindrical body 1 includes a shaft portion A1 and a shaft hole A2 on the central axis A.

The cylindrical body 1 includes a cylindrical main body 11 and a partition wall 12 that partitions the cylindrical main body 11 perpendicularly to the central axis A, and the internal space is divided into two. In addition, the cylindrical body 1 includes a holding portion 13 that holds the capsule C, a carrier storage portion 14 for holding and storing the carrier 4 and the sub-carrier 7, and the shaft hole A2.

In the embodiment, the holding portion 13 and the carrier storage portion 14 are provided on both sides of the partition wall 12, a first holding portion 13A and a first carrier storage portion 14A that stores the carrier 4 are provided on a side facing the suction portion 3, and a second holding portion 13B and a second carrier storage portion 14B that stores the sub-carrier 7 are provided on a side facing the bottom base 5.

The cylindrical main body 11 is not provided with fitting portions serving as a key or a key groove, and can relatively rotate independently of the rotating body 2, the suction portion 3, and the bottom base 5. As described above, a material between the suction portion 3 and the bottom base 5 is exposed to the outside and relatively rotates, so that the user can easily recognize a usage method. On the outer peripheral surface of the cylindrical main body 11, recessed and projection parts parallel to the axial direction is provided at equal intervals.

In both the first holding portion 13A and the second holding portion 13B, the holding portion 13 includes, similar to the first embodiment, a partition 131, a capsule base 132, and a path hole 133 protruding from the partition wall 12, and an opening 134 provided in the partition wall 12. Here, an end portion of the partition 131 is provided away from the end portion of the cylindrical main body 11 so that the end surface is opened, and a cylindrical body covering the space between the partition 131 and the end portion of the cylindrical main body 11 or the peripheral surface thereof becomes the carrier storage portion 14. As a result, the capsule C held on the capsule base 132 directly faces the carrier 4 or the sub-carrier 7, and the leaked liquid can be easily held.

The carrier storage portion 14 is a cylindrical member provided to extend from both ends of the cylindrical main body 11, and can hold the carrier 4 or the sub-carrier 7 inside. In the carrier storage portion 14, one end of the outer peripheral surface is fitted to the inner peripheral surface of the suction portion 3, and the other end of the outer peripheral surface is fitted to the inner peripheral surface of the bottom base 5. The outer peripheral surface is smooth and is an inwardly recessed step to define an attachment position.

Further, in the embodiment, the opening 134 is an opening provided on the partition wall 12 so that the first holding portion 13A and the second holding portion 13B pass therethrough, and communicates with a carrier on the opposite side of the one holding portion 13 so as to allow the liquid to pass therethrough and to hold the liquid agent, and allows gas to pass therethrough and facilitates suction.

The shaft hole A2 is a hole provided in a cylindrical material having substantially the same height as the partition 131. The partition 131 is disposed so as to surround the periphery of the cylindrical material.

The rotating body 2 is sandwiched between the cylindrical body 1 and the suction portion 3, and is provided so as to cooperate with the suction portion 3 and to be relatively rotatable with respect to the cylindrical body 1. The rotating body 2 includes a disk-shaped rotating board 21 whose outer diameter is substantially the same as or slightly smaller than the inner diameter of the suction portion 3, a blade portion 22 extending from the rotating board 21 toward the cylindrical body 1, a rotating body fitting portion 24, and a shaft portion A1 extending toward the bottom base 5.

In the embodiment, the rotating board 21 is sandwiched between the cylindrical body 1 and the suction portion 3 in the axial direction, and the surface on the cylindrical body 1 side abuts on the carrier 4. Further, the rotating board 21 is provided with a vent hole 211 for inserting the volatilized liquid into the suction portion 3. In addition, the blade portion 22 penetrates the carrier 4 and further extends to the inside of the capsule base 132 so that the capsule C can be broken. The rotating body 2 and the suction portion 3 can rotate in cooperation with each other as the rotating body fitting portion 24 is in a relationship of a key and a key groove with the suction fitting portion 33. The cylindrical shaft portion A1 extends from the center of the rotating board 21, and an end portion of the shaft portion A1 is fitted to the inside of a sub-rotating shaft hole A22, so that the rotating body 2 and the sub-rotating body 8 rotate in cooperation.

The carrier 4 is stored in the first carrier storage portion 14A, and is provided with a penetration hole 41 into which the blade portion 22 penetrates, and a shaft hole A2. The carrier 4 forms a space for holding the capsule C in cooperation with the capsule base 132 of the first holding portion 13A. In addition, the sub-carrier 7 has the same structure having a thickness larger than that of the carrier 4, includes the shaft hole A2, and is stored in the second carrier storage portion 14B.

The bottom base 5 includes a bottom cylinder 51, a bottom surface portion 52, and a bottom shaft hole A21. In the embodiment, the bottom shaft hole A21 is provided as a simple opening separated from the shaft portion A1, and also serves as a suction hole 521.

The sub-rotating body 8 is sandwiched between the cylindrical body 1 and the bottom base 5, and is provided so as to cooperate with the bottom base 5 and to be relatively rotatable with respect to the cylindrical body 1. The structure of the sub-rotating body 8 is substantially the same as that of the rotating body 2, and includes a disc-shaped sub-rotating board 81, a sub-blade portion 82 extending from the sub-rotating board 81 toward the cylindrical body 1, a sub-rotating body fitting portion 83, and the sub-rotating shaft hole A22 into which the shaft portion A1 penetrates.

The sub-rotating board 81 has substantially the same function and structure as the rotating board 21, and a sub-vent hole 811 provided in the surface of the sub-rotating board 81 opens the bottom base 5 and the sub-carrier 7 to facilitate suction. The sub-blade portion 82 is longer than the blade portion 22 so as to penetrate the sub-carrier 7. The sub-rotating body fitting portion 83 rotates in cooperation with the bottom base 5 by being fitted in a bottom base fitting portion 513.

The sub-rotating shaft hole A22 is a cylindrical member extending from the sub-rotating board 81 toward the suction portion 3, and an inner peripheral surface of the sub-rotating shaft hole A22 is fitted to the shaft portion A1. Since the inner peripheral surface has a non-circular shape, the sub-rotating shaft hole A22 cooperates with the shaft portion A1 and the rotating body 2 and the sub-rotating body 8 rotate in cooperation with each other.

In a method of using a suction tool according to the present embodiment, first, a user rotates the cylindrical body 1 while holding the suction portion 3 or the bottom base 5 to break the capsule C inside. Next, the user waits until volatilization of the liquid agent held by the carrier 4 or the sub-carrier 7 is started, and then performs suction.

Here, since the carrier 4 capable of holding the liquid agent in the capsule C is disposed between the suction portion 3 and the bottom base 5, it is easy to volatilize and suck the liquid agent. In addition, since the carrier 4 is disposed between the capsule base 132 and the suction portion 3, the liquid agent is prevented from directly flowing into the suction portion 3. Furthermore, by making the carrier 4 adjacent to the capsule base 132, the liquid agent leaking is reliably held.

In addition, since the blade portion 22 protrudes parallel to the central axis A, the capsule C can be acted on with a simple structure without interfering with the blade portion 22. Meanwhile, the blade portion 22 may be provided so as to protrude from the inner peripheral surface of the cylindrical rotating body 2 toward the central axis A, and according to this, it is possible to increase the distance from the central axis A to the maximum and to improve the breaking force on the capsule C.

In addition, since the plurality of blade portions 22 is provided at intervals, the amount of rotation required to break the capsule C is reduced, and the use performance can be enhanced. Furthermore, since the plurality of blade portions 22 is in the same movement path and the path hole 133 is further provided, even if some of the blade portions 22 are broken, the other blade portions 22 can act, which is in a failsoft manner.

In addition, since a plurality of the capsule bases 132 are provided on the movement path R, the amount of liquid agent that can be sucked by one suction tool X can be increased. The separation of the capsule base 132 from the central axis A facilitates this design.

In addition, since a plurality of the holding portions 13 is provided in the axial direction and the blade portion faces the holding portions, the amount of liquid agent that can be sucked is further increased. Note that the amount of the liquid agent that can be sucked from one suction tool X may be increased by further connecting another cylindrical body or rotating body in the axial direction between the cylindrical body 1 and the bottom base 5.

As another modified example, a bottom base 5 may be provided so as to be adjacent to a rotating body 2 without providing a sub-cylindrical body 6 to make it more compact. In the embodiment, the blade portion 22 can break the plurality of capsules C at a time, but the number of blade portions 22 may be made smaller than the number of capsules C so that the capsules C can be broken one by one or several by several. In this case, it is preferable to further provide a mechanism capable of temporarily stopping when the rotating body 2 reaches a predetermined relative angle. In the first embodiment, the cylindrical body 1, the suction portion 3, the bottom base 5, and the sub-cylindrical body 6 are provided so as to rotate integrally, but a cylindrical body 1 and a sub-cylindrical body 6 may be configured to rotate separately, and in the second embodiment, the rotating body 2 and the sub-rotating body 8 may be configured to rotate separately. As a result, the capsules C stored in the respective holding portions can be sucked separately. In this case, if the liquid agents enclosed in the capsules C are different from each other, variations of the capsules C increase and the use performance is further enhanced. Further, a shaft portion A1 may be provided on a central axis A of any one of the cylindrical body 1, the rotating body 2, the suction portion 3, and the bottom base 5, and may be provided with a shaft hole A2 for penetrating the shaft portion at a position corresponding to the central axis A of the other member, and the shaft portion A1 may extend in both directions. In addition, the capsule C may be broken in stages by making the lengths and materials of a plurality of the blade portions 22 different from each other.

REFERENCE SIGNS LIST

X suction tool
1 cylindrical body
11 cylindrical main body
12 partition wall
13 holding portion
131 partition
132 capsule base
133 path hole
134 opening
13A first holding portion
13B second holding portion
14 carrier storage portion
14A first carrier storage portion
14B second carrier storage portion
15 holding portion fitting portion
2 rotating body
21 rotating board
211 vent hole
22 blade portion
22A first blade
22B second blade
23 rotating cylinder
24 rotation fitting portion
3 suction portion
31 nozzle main body
311 suction hole

312 return part
32 cylinder covering portion
33 suction fitting portion
4 carrier
5 bottom base
51 bottom cylinder
511 insertion portion
512 extension portion
513 bottom base fitting portion
52 bottom surface portion
521 suction hole
6 sub-cylindrical body
61 sub-cylindrical main body
62 sub-partition wall
63 sub-holding portion
64 sub-carrier storage portion
65 sub-holding portion fitting portion
7 sub-carrier
8 sub-rotating body
81 sub-rotating board
811 sub-vent hole
82 sub-blade portion
83 sub-rotating body fitting portion
C capsule
A central axis
A1 shaft portion
A2 shaft hole
A21 bottom shaft hole
A22 sub-rotating shaft hole
R movement path

What is claimed is:

1. A suction tool comprising: a cylindrical body; a rotating body coupled to the cylindrical body so as to be relatively rotatable about a central axis; and a suction portion that communicates with an outside, wherein the cylindrical body includes a holding portion that holds a capsule, the rotating body includes a blade portion capable of breaking the capsule, the holding portion has an internal space partitioned by a partition provided with a height in an axial direction, and includes capsule bases that are defined by a peripheral surface of the partition with a height in the axial direction and internally store and hold the capsule at a position away from the central axis, the blade portion is provided so as to relatively move along a movement path and penetrate into the capsule bases when the rotating body relatively rotates, the capsule bases are disposed on the movement path, the partition includes a path hole that allows the capsule bases to communicate with each other on the movement path, and the path hole has a width wider than a width of the blade portion and is provided to be able to pass through the blade portion.

2. The suction tool according to claim 1, wherein a carrier capable of holding a liquid agent inside the capsule is disposed between the capsule base and the suction portion.

3. The suction tool according to claim 1, wherein the blade portion protrudes in parallel with the central axis.

4. The suction tool according to claim 1, wherein a plurality of the blade portions is provided at intervals.

5. The suction tool according to claim 1, wherein a plurality of the capsule bases is provided on the movement path.

6. The suction tool according to claim 1, wherein a plurality of the holding portions is provided in the axial direction, and each of the blade portions faces a respective one of the holding portions.

7. The suction tool according to claim 2, wherein a plurality of the holding portions is provided in the axial direction, and each of the blade portions faces a respective one of the holding portions.

8. The suction tool according to claim 3, wherein a plurality of the holding portions is provided in the axial direction, and each of the blade portions faces a respective one of the holding portions.

9. The suction tool according to claim 4, wherein a plurality of the holding portions is provided in the axial direction, and each of the blade portions faces a respective one of the holding portions.

10. The suction tool according to claim 5, wherein a plurality of the holding portions is provided in the axial direction, and each of the blade portions faces a respective one of the holding portions.

* * * * *